United States Patent [19]

Ramage

[11] Patent Number: 4,658,990

[45] Date of Patent: Apr. 21, 1987

[54] FLUID HOLDING AND DISPENSING DEVICE

[76] Inventor: Gerald A. Ramage, 3560 S.E. Rothe Rd., Milwaukie, Oreg. 97222

[21] Appl. No.: 668,578

[22] Filed: Nov. 5, 1984

[51] Int. Cl.[4] ..... B65D 37/00

[52] U.S. Cl. ..... 222/106; 222/92; 222/107; 222/212; 222/484; 222/507; 222/523; 222/525; 222/528; 222/192; 239/289; 239/33; 141/2; 141/18; 141/21; D7/42

[58] Field of Search ..... 222/92, 106, 107, 464, 222/501, 507, 522, 523, 525, 526, 531, 537, 544, 547, 79, 212, 213, 386.5, 482, 484; 220/90.2, 90.4; 206/217; 141/2, 18, 21; 239/33, 289, 302; D7/42, 75

[56] References Cited

U.S. PATENT DOCUMENTS

| | | | |
|---|---|---|---|
| 921,085 | 5/1909 | Clark | 222/211 |
| 2,222,267 | 11/1940 | Schnabel | 222/107 |
| 2,288,848 | 7/1942 | Schuessler | 239/33 |
| 2,605,022 | 7/1952 | Nieland | 222/211 |
| 2,752,199 | 6/1956 | Newell, Jr. | 222/211 X |
| 2,815,981 | 12/1957 | Nonnamaker et al. | 239/33 |
| 2,948,453 | 8/1960 | Drown . | |
| 3,518,018 | 6/1970 | Woods | 222/132 X |
| 3,718,282 | 2/1973 | Pizzoferrato . | |
| 3,779,430 | 12/1973 | Niki | 222/501 |
| 3,940,026 | 2/1976 | Kain | 222/215 X |
| 3,961,725 | 6/1976 | Clark | 222/386.5 X |
| 4,109,817 | 8/1978 | Payne et al. | 220/90.2 |
| 4,134,494 | 1/1979 | Wong | D7/42 X |
| 4,168,032 | 9/1979 | Sneider | 222/215 X |
| 4,217,994 | 8/1980 | Koenig et al. | 222/501 X |
| 4,222,499 | 9/1980 | Lee et al. | 222/215 X |
| 4,274,555 | 6/1981 | Sneider | 222/107 |
| 4,324,350 | 4/1982 | Thompson | 222/386.5 |
| 4,340,175 | 7/1982 | Danek et al. | 239/33 |
| 4,424,913 | 1/1984 | Ko . | |
| 4,428,490 | 1/1984 | Holloway . | |
| 4,487,336 | 12/1984 | Sneider | 222/107 |
| 4,519,794 | 5/1985 | Sneider | 222/544 X |

*Primary Examiner*—Joseph J. Rolla
*Assistant Examiner*—P. McCoy Smith
*Attorney, Agent, or Firm*—John W. Stuart

[57] ABSTRACT

A fluid container and dispenser including an elastomeric reservoir and a dispensing tube connected thereto and a valve to either allow or inhibit fluid flow into or out of the reservoir. One embodiment includes an elongate tube with a hole in one side and an elastomeric sleeve surrounding a portion of the tube. A sliding valve element is mounted in the tube to close the hole. The valve element is mounted on a second, smaller tube which slides within the first-mentioned tube. The sleeve is filled by sliding the valve element away from the hole and injecting fluid under pressure into the sleeve to expand it. The valve then is slid to its closed position. The combined first-mentioned and second tubes together form a straw to withdraw fluid from a secondary container into which fluid may be dispensed.

26 Claims, 11 Drawing Figures

FIG. 1
FIG. 2
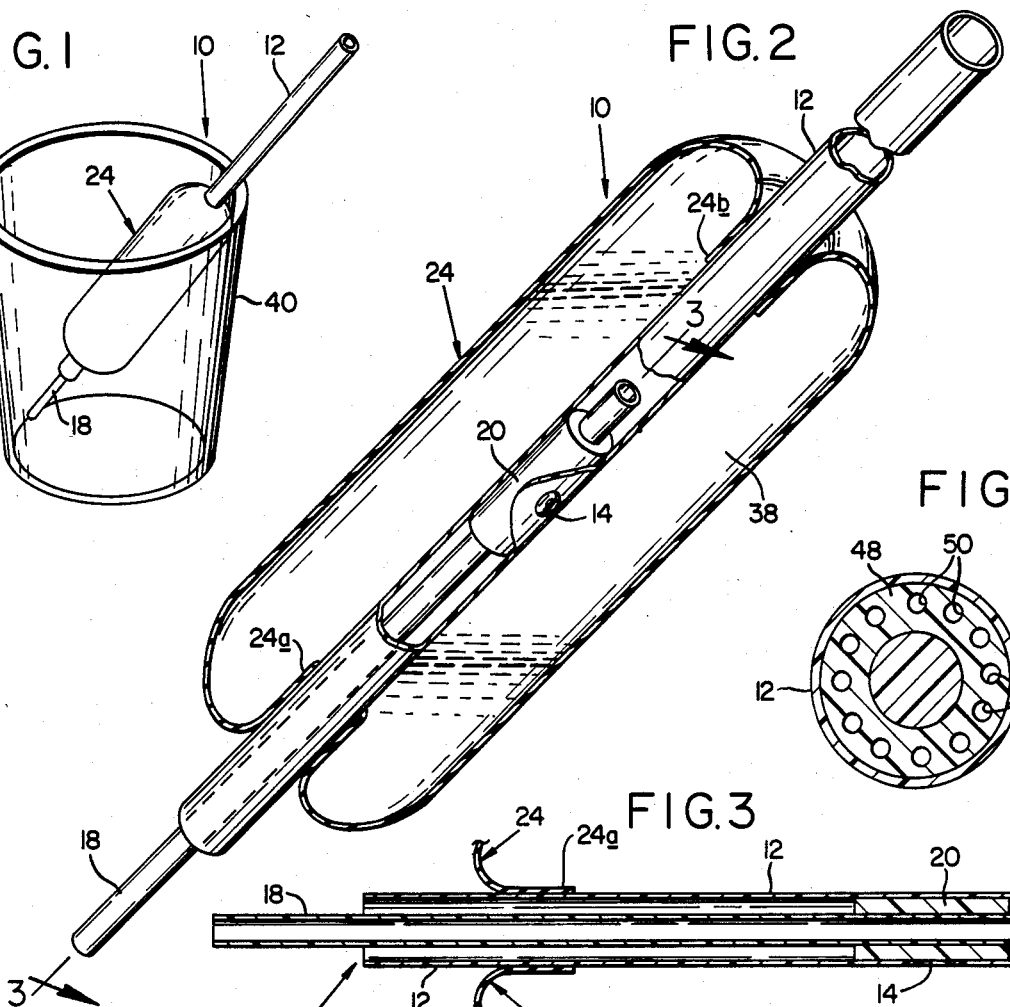
FIG. 5
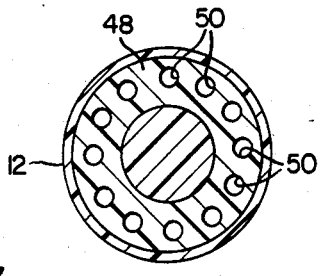
FIG. 3
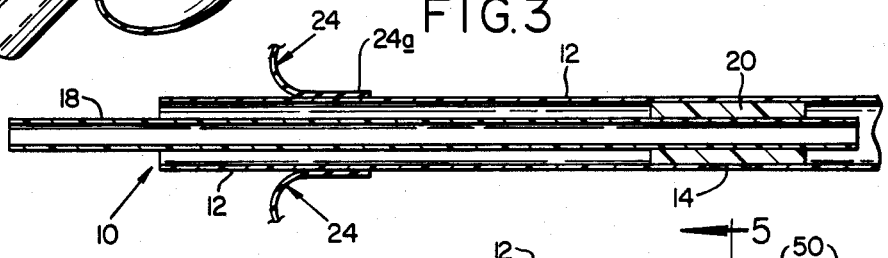
FIG. 4
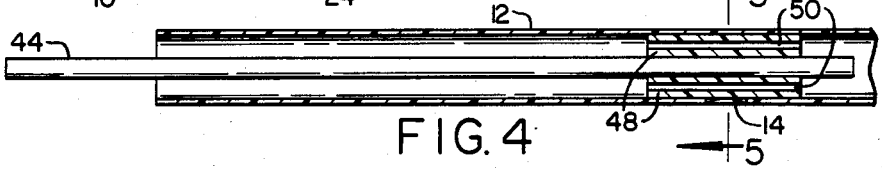
FIG. 6
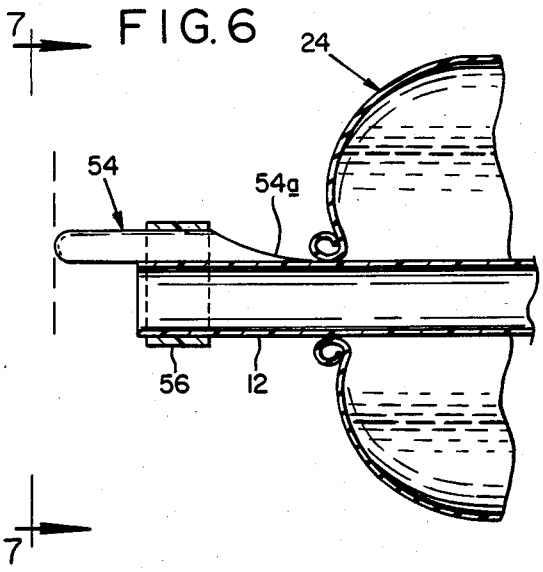
FIG. 7
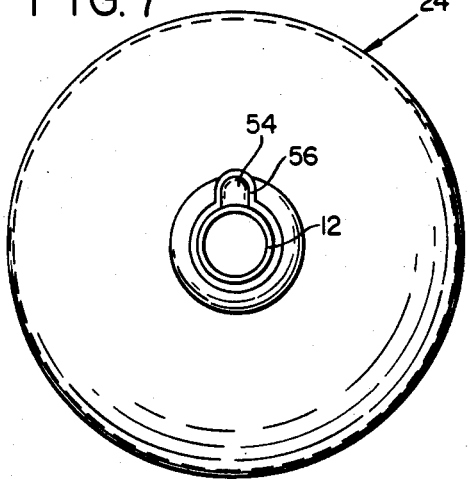

FLUID HOLDING AND DISPENSING DEVICE

BACKGROUND AND SUMMARY OF THE INVENTION

This invention relates to a fluid holding and dispensing device and to a method for filling the same.

In the past, a variety of fluid-holding and dispensing devices have been known. For use with beverages, these have consisted generally of substantially rigid containers from which liquid is poured into a secondary container or from which the liquid is withdrawn with a straw. For the most part, these have been heavy and often difficult to store, although space and weight carrying capacity may be at a premium. Such conditions may be found in the air transport industry where it is desirable to carry as little weight as possible and storage space may be limited.

A general object of the present invention is to provide a novel fluid-holding and dispensing container which is light weight and occupies minimum space.

Another object of the invention is to provide a novel fluid container from which fluid may be dispensed and which can function as a straw to withdraw fluid from a secondary container into which the fluid is dispensed.

A still further object is to provide a novel fluid container which is simple and inexpensive to construct and which holds fluid under pressure for dispensing under force.

DRAWINGS

These and other objects and advantages will become apparent as the following description is read in conjunction with the drawings in which:

FIG. 1 is a perspective view of a fluid-holding and dispensing device according to an embodiment of the invention resting in a glass;

FIG. 2 is an enlarged perspective view of the device of FIG. 1 removed from the glass and with portions broken away to illustrate internal structure;

FIG. 3 is a cross sectional view of a portion of the device taken along the line 3—3 in FIG. 2;

FIG. 4 is a view similar to that of FIG. 3, but of a modified embodiment of the invention;

FIG. 5 is an enlarged cross sectional view taken generally along the line 5—5 in FIG. 4;

FIG. 6 is an enlarged side elevation view of an end portion of another embodiment of the invention;

FIG. 7 is an end view of the FIG. 6 embodiment taken along the line 7—7;

DESCRIPTION OF EMBODIMENTS OF THE INVENTION

Figure 8:
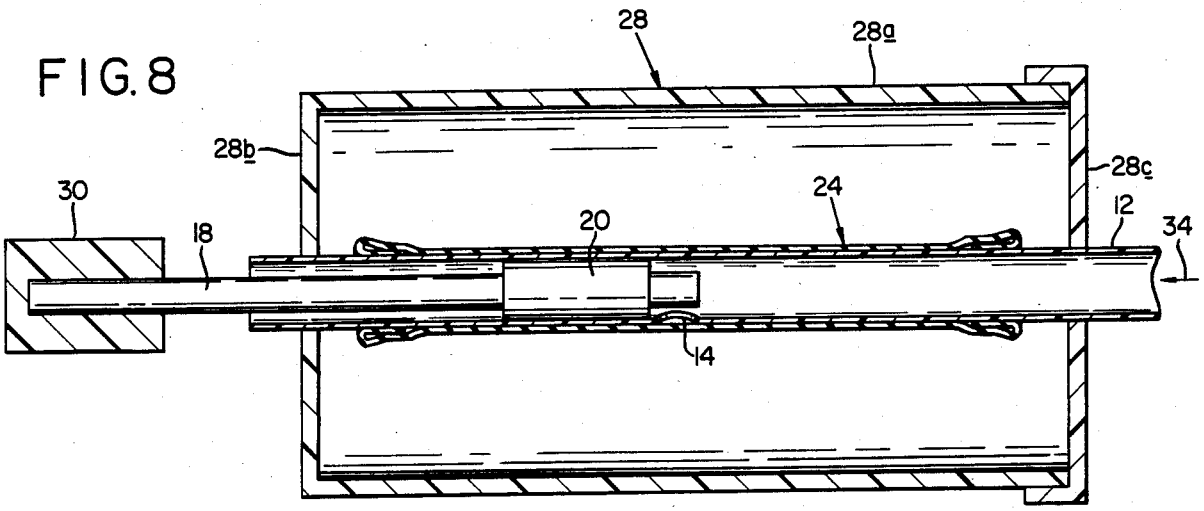
FIG. 8 is a cross sectional view of a device according to one embodiment of the invention situated in a frame, or mold, ready for filling.

Referring to the drawings, and first more particularly to FIGS. 1 and 2, at 10 is indicated generally a fluid holding and dispensing device according to one preferred embodiment of the invention. The device includes an elongate first tube 12 which has a hole, or orifice, 14 formed in one side thereof. In the illustrated embodiment, tube 12 is a drinking straw.

A second tube, or straw, 18 having a smaller external diameter than the internal diameter of straw 12 is slidably received in straw 12. Tube 18 is also referred to herein as an operating element.

Figure 10:
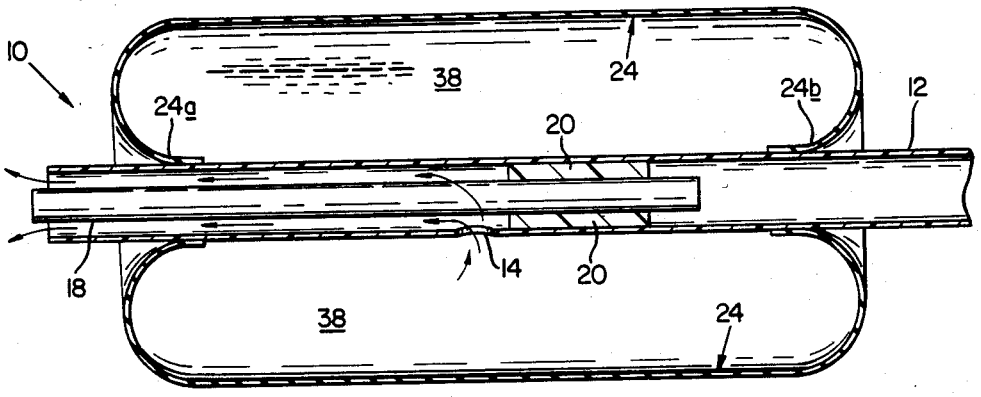
FIG. 10 is a view similar to FIG. 8 with the mold removed and the device positioned to dispense fluid.

A cylindrical sealing element, or valve means, 20 is secured to tube 18 adjacent its upper end as viewed in FIG. 2. Tube 18 extends fully through the sealing element with a portion of tube 18 extending outwardly above element 20. The sealing element is an elastomeric member which fits sealingly and slidably against the inner surface of straw 12. When in a first position, as illustrated in FIG. 2, it closes off hole 14 to prevent material flow therethrough. The sealing element is shiftable up or down in straw 12 to a second position illustrated in FIGS. 10 and 11 spaced from hole 14 to permit material flow therethrough.

Tube 18 is of such length that when sealing member 20 is in its first, or closing, position the lower end of tube 18 extends outwardly from straw 12 so that it may be engaged for shifting, or manipulation. It may be slid into or out of straw 12 to shift the sealing element between its open and closed positions.

Surrounding a portion of straw 12 is an elongate elastomeric sleeve, or reservoir, 24. The sleeve is of such size that when first installed on straw 12, in an at rest or collapsed condition, it rests closely adjacent straw 12. The sleeve is constructed of a material which will expand when fluid is injected therein under pressure to assume a shape as illustrated in FIGS. 1, 2, 9, and 10. As is seen, the opposed ends **24*a* and 24*b*** of the sleeve are turned in and under to provide an effective seal at opposite ends of the sleeve to maintain a pressurized condition within the reservoir surrounding the straw provided by the sleeve.

Figure 9:
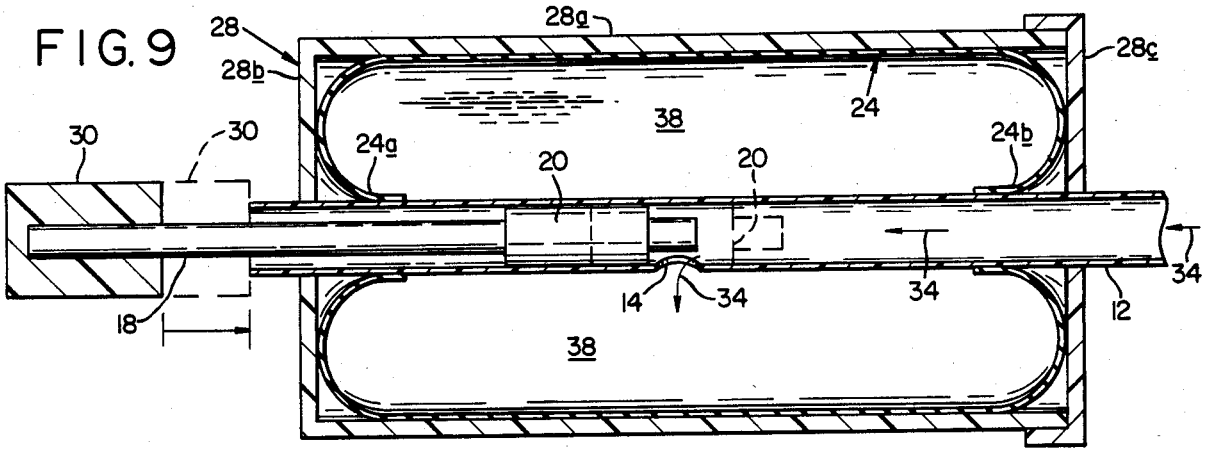
FIG. 9 is a view similar to FIG. 8 during the filling process.

A method for filling the device as thus far described is illustrated schematically in FIGS. 8 and 9. The portion of the device including sleeve 24 is enclosed in a frame, or mold, 28 having a cylindrical main housing portion **28*a* and end portions 28*b*, 28*c*. The end portions have holes therein for receiving straw 12** therethrough, and the mold is generally of the size to which it is desired the sleeve will expand when filled with a preselected desired quantity of fluid.

The end of tube 18 opposite sealing element 20 is closed, as by a stopper 30, and the tube and sealing element are shifted to the left to open hole 14. Fluid under pressure is injected into straw 12 as indicated by arrows 34, and this flows through hole 14 into sleeve 24 which expands as illustrated in FIG. 9. When the sleeve has received a preselected quantity of fluid and fills the mold, the sealing element is shifted back to its closed position as illustrated in dotted outline in FIG. 9 to trap or hold the fluid in the reservoir, and the mold and stopper are removed. Thus filled with fluid 38, the device has the form illustrated in FIGS. 1 and 2. The device holding fluid is compact and relatively lightweight. The fluid is retained in the reservoir under the pressure of the expanded elastomeric sleeve 28, ready for dispensing when desired.

Dispensing fluid from the device is a simple matter. Assuming the fluid is a beverage, or fluid to mix in a beverage, the device is set in a glass as shown in FIG. 1 with tube 18 resting on the bottom of the glass. By pressing tube 18 against the bottom of the glass, it and sealing element 20 are shifted upwardly in straw 12 to the position shown in FIG. 10. In this position, hole 14 is opened and fluid is forced out under pressure into the waiting glass. The sleeve should force out substantially all of the fluid and assume the condition shown in FIG. 11 with the sleeve resting against straw 12.

Figure 11:
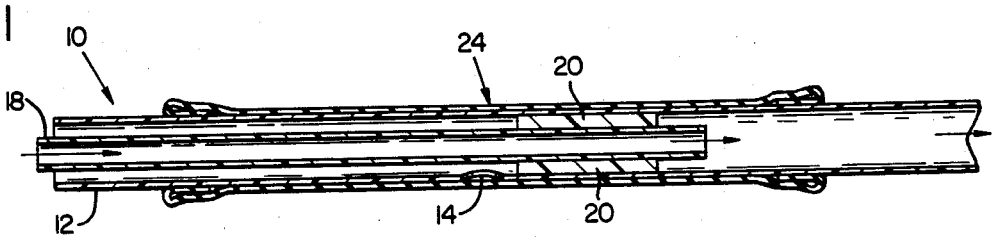
FIG. 11 is a cross sectional view of the device used as a straw or withdrawing tube.

As illustrated in FIG. 11, the internal bores of tubes 12 and 18 together act as a common conduit through which fluid can be withdrawn from the glass 40, as with a common straw. The device thus provides a container for a drink or other fluid, and after being dispensed, allows the device to be used as a straw. The device can then be merely discarded due to its being constructed of inexpensive materials, or it can be refilled for subsequent use.

In FIGS. 4 and 5, an alternate embodiment is shown. The basic construction is as described above except for the operating and sealing elements. In this embodiment, the operating element is an elongate solid rod 44 and the sealing element is a cylindrical member 48 having a plurality of bores, or holes, 50 extending fully therethrough. The bores extend generally longitudinally of straw 12 as did the internal bore of tube 18 in the previously described embodiment.

The filling of the embodiment illustrated in FIGS. 4 and 5 is substantially the same as described above, with the exception that the entire lower end of tube 12 must be closed off. Further, when the device is used as a straw, fluid is not drawn through the elongate operating element, but instead flows upwardly through the lower portion of the straw 12 itself, then through bores 50, and then continues upwardly through the upper portion of the straw.

A third embodiment is shown in FIGS. 6 and 7. Here only the lower end of the straw 12 and sleeve 24 are illustrated. No hole is provided through a side of the straw and no second tube or sealing element similar to 20 or 48 are used. Instead, a slidably mounted opening element 54 having a sharpened end 54*a* is mounted on one side of the straw. A holder 56 slidably holds element 54 in the position shown in FIG. 6 with its end opposite end 54*a* projecting beyond the lower end of straw 12.

With the device filled as shown, it is a simple matter to slide element 54 longitudinally of straw 12 to a point where its end 54*a* lifts an end portion of sleeve 24 from its sealing engagement with the straw to allow the fluid to flow therefrom.

Although only cylindrical tubes and sleeves have been illustrated herein, it will be recognized that a variety of shapes are possible. For example, the reservoir could advantageously be of a cubic or rectangular shape to permit more compact packing in a box or on shelves.

From the above, it will be seen that the present invention provides a simple and inexpensive means for holding fluids under pressure for dispensing as desired. Both the filling and dispensing of fluid are easily accomplished.

Although preferred embodiments of the invention have been described herein, it is recognized that variations and modifications are possible without departing from the spirit of the invention.

I claim:

1. A fluid container and dispenser device comprising a reservoir for holding fluid, an elongate tube extending through said reservoir, said tube having an opening in one side thereof in the region of said reservoir through which fluid may flow between said reservoir and tube, and valve means movably mounted in said tube for shifting between a first position, closing off said opening to prevent fluid flow, and a second position permitting fluid flow therebetween.

2. The device of claim 1, wherein said reservoir comprises an elastomeric sleeve extending about said tube.

3. The device of claim 1, which further comprises an elongate operating element movably mounted within said tube, and said valve means is connected to said operating element for movement therewith.

4. The device of claim 3, wherein said valve means comprises a sealing element slidably and sealingly fitted in said tube.

5. The device of claim 4, wherein one of said elements has a bore extending therethrough through which fluid may flow past said sealing element from a portion of said tube on one side of said sealing element to a portion of said tube on the opposite side of said sealing element.

6. The device of claim 5, wherein said bore extends through said sealing element in a direction extending substantially longitudinally of said tube.

7. The device of claim 4, wherein said operating element comprises a second tube having an external cross section smaller than the internal cross section of said first-mentioned tube.

8. The device of claim 3, wherein said tube comprises a drinking straw and said reservoir comprises an elastomeric sleeve surrounding a portion of said straw, with the ends of said sleeve sealingly connected to the exterior of said straw.

9. The device of claim 8, wherein said sleeve when empty and collapsed rests closely adjacent said straw and when filled, expands to hold fluid under pressure.

10. The device of claim 8, wherein said operating element comprises a second tube of smaller cross section than the internal cross section of said straw, and said second tube extends fully through said valve means.

11. The device in claim 10, wherein said second tube has such length that it projects from one end of said straw when said valve means is in its first position to be engaged for applying a shifting force to move it and said valve means to said second position.

12. The device of claim 3, wherein said operating element has such length that when said valve means is in its first position, said operating element extends outwardly from one end of the tube allowing it to be engaged for applying a shifting force to move said operating element and sealing element to said second position.

13. A fluid containing device comprising a tube having an orifice therein, an elastomeric reservoir connected to said tube whereby fluid may flow through said orifice between the interior of the tube and said reservoir, valve means movably mounted in said tube for shifting between a first position closing said orifice to prevent fluid flow therebetween and a second position permitting such fluid flow, and an elongate operating element movably mounted in said tube with a portion of said operating element extending outwardly from said tube for manipulation, and said valve means is connected to said operating element for movement therewith.

14. The device of claim 13, wherein said valve means comprises a sealing element slidably and sealingly fitted within said tube, and one of said elements has a bore extending therethrough through which fluid may flow past said sealing element from a portion of said tube on one side of said sealing element to a portion of said tube on the other side of the sealing element.

15. The device of claim 14, wherein said operating element comprises a second tube having an external cross section smaller than the internal cross section of said first-mentioned tube.

16. The device of claim 14, wherein said bore extends through said sealing element in a direction extending substantially longitudinally of said tube.

17. The device of claim 16, wherein said tube comprises a drinking straw and said reservoir comprises an elastomeric sleeve surrounding a portion of said straw with the ends of said sleeve sealingly connected to said straw.

18. The device of claim 17, wherein said sleeve when empty and collapsed rests closely adjacent said straw and when filled expands to hold fluid under pressure.

19. The device of claim 17, wherein said operating element is a second tube of smaller cross section than the internal cross section of said straw, and said second tube extends fully through said valve means.

20. A combination straw and drink holding device comprising:

an enclosed reservoir for holding fluid, an elongate straw extending through said reservoir, said tube having an opening in one side thereof in the region of said reservoir through which fluid may flow between the straw and reservoir, and valve means mounted for shifting between a first position closing said opening to prevent fluid flow between said tube and reservoir and a second position permitting fluid flow therebetween.

21. The device of claim 20, wherein said valve means comprises a sealing element mounted in said straw for shifting longitudinally of said straw between said first and second positions.

22. The device of claim 20, wherein said reservoir comprises an elastomeric sleeve extending about said straw with opposite ends of said sleeve sealingly engaging said straw.

23. The device of claim 20, which further comprises a second elongate straw movably mounted within said first-mentioned straw, said second straw having an external cross section smaller than the internal cross section of said first-mentioned straw, and said valve means is connected to said second straw for movement therewith.

24. The device of claim 22, wherein said sleeve when empty and collapsed rests closely adjacent said straw and when filled expands to hold fluid under pressure.

25. The device of claim 23, wherein said second straw has such length that it projects from one end of said first-mentioned straw when said valve means is in its first position to be engaged for applying a shifting force to move it and said valve means to said second position.

26. The device of claim 23, wherein said valve means comprises a sealing element slidably and sealingly fitted within said tube.

* * * * *